US005117846A

United States Patent [19]

Finamore et al.

[11] Patent Number: 5,117,846

[45] Date of Patent: Jun. 2, 1992

[54] HAIRPIECE AND FITTING METHOD THEREFOR

[75] Inventors: Paul V. Finamore, Chicago; Robert G. Pancic, Palatine, both of Ill.

[73] Assignee: Hairline Creations, Inc., Chicago, Ill.

[21] Appl. No.: 683,489

[22] Filed: Apr. 9, 1991

Related U.S. Application Data

[63] Continuation of Ser. No. 492,609, Mar. 13, 1990, abandoned.

[51] Int. Cl.[5] ..... A41G 5/00

[52] U.S. Cl. ..... 132/54; 132/53

[58] Field of Search ..... 132/53, 54, 201, 55, 132/56

[56] References Cited

U.S. PATENT DOCUMENTS

| | | | |
|---|---|---|---|
| 3,421,521 | 1/1969 | Rich, Jr. . | |
| 3,520,309 | 7/1970 | Lane et al. . | |
| 3,612,071 | 10/1971 | Holly | 132/53 |
| 4,386,619 | 6/1983 | Williams | 132/53 |

FOREIGN PATENT DOCUMENTS

| | | | |
|---|---|---|---|
| 1954258 | 5/1971 | Fed. Rep. of Germany | 132/53 |
| 2302421 | 7/1974 | Fed. Rep. of Germany | 132/53 |
| 2500170 | 7/1976 | Fed. Rep. of Germany | 132/53 |
| 3542123 | 6/1987 | Fed. Rep. of Germany | 132/53 |
| 2283639 | 4/1976 | France | 132/53 |
| 8300086 | 8/1984 | Netherlands | 132/54 |

*Primary Examiner*—Gene Mancene
*Assistant Examiner*—Michael Lynch
*Attorney, Agent, or Firm*—Trexler, Bushnell, Giangiorgi & Blackstone, Ltd.

[57] ABSTRACT

A hairpiece construction includes a reticulate foundation sheet member having a mesh structure of generally regular mesh openings and a generally domed configuration adapted to the contour of a wearer's scalp and head. The reticulate foundation sheet member also includes a plurality of through apertures with effective diameters larger than the mesh openings in order to enable manipulated feeding of the wearer's own hair strands through the respective apertures during the fitting operation. The apertures are distributed in a spaced arrangement so that even limited amounts and pattern of the wearer's own hair can be fed through the apertures and thereby contribute to the anchoring and stability of the foundation and hairpiece. The hair strands of the hairpiece are secured directly to the reticulate foundation.

5 Claims, 2 Drawing Sheets

HAIRPIECE AND FITTING METHOD THEREFOR

This application is a continuation of application Ser. No. 07/492,609, filed Mar. 13, 1990, now abandoned.

BACKGROUND OF THE INVENTION

The present invention relates to hairpiece construction and fitting, and more particularly relates to improved hairpiece foundations and wearing comfort.

Developments in the construction of hairpieces and foundations have greatly improved the scalp ventilation, appearance and comfort to the wearer, for example as described in U.S. Pat. No. 4,517,999 which is incorporated by reference herein for extensive discussion of materials and construction methods. The present invention is directed to still further improvement not only in scalp ventilation but, in addition, to the stability of the foundation securement and the natural appearance of the fitted hairpiece.

SUMMARY OF THE INVENTION

In accordance with the present invention, hairpiece construction includes a reticulate foundation sheet member having a mesh structure of generally regular mesh openings and a generally domed configuration adapted to the contour of a wearer's scalp and head. The reticulate foundation sheet member also includes a plurality of through apertures with effective diameters larger than the mesh openings in order to enable manipulated feeding of the wearer's own hair strands through the respective apertures during the fitting operation. The apertures are distributed in a spaced arrangement so that even limited amounts and pattern of the wearer's own hair can be fed through the apertures and thereby contribute to the anchoring and stability of the foundation and hairpiece. The hair strands of the hairpiece are secured directly to the reticulate foundation.

In a preferred embodiment, the reticulate foundation sheet member of the hairpiece is a moldable plastic mesh such as nylon filament mesh, with heat perforated apertures approximately twice the mesh size up to about one-half inch. The edges of the apertures are heated to eliminate any sharply severed filament ends which could otherwise cause irritation of the wearer's scalp. In the fitting operation the hairpiece foundation is applied to the wearer's head and then the wearer's own hair strands are fed through respective apertures to produce improved scalp ventilation through the apertures, as well as improved stability and secured location of the hairpiece and foundation to the wearer's scalp. Primary securement of the hairpiece foundation is achieved in any conventional manner, preferably with an adhesive agent such as a double-sided tape.

DESCRIPTION OF THE ILLUSTRATED EMBODIMENT

Figure 1:
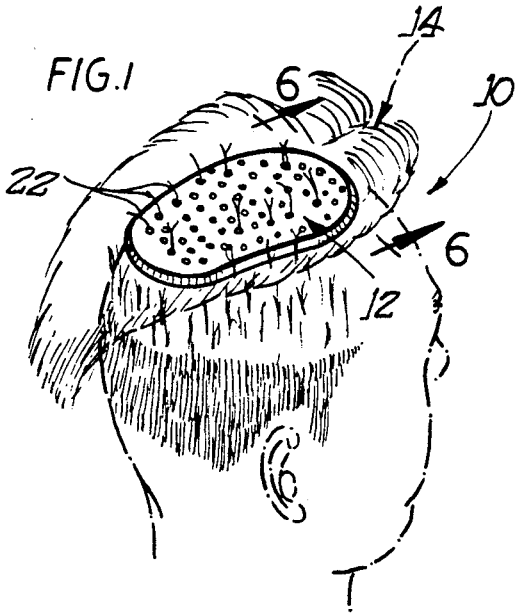
FIG. 1 is a perspective view of a hairpiece in accordance with one embodiment of the invention, and shows the fitting of the hairpiece upon a wearer's head.
Figure 4:
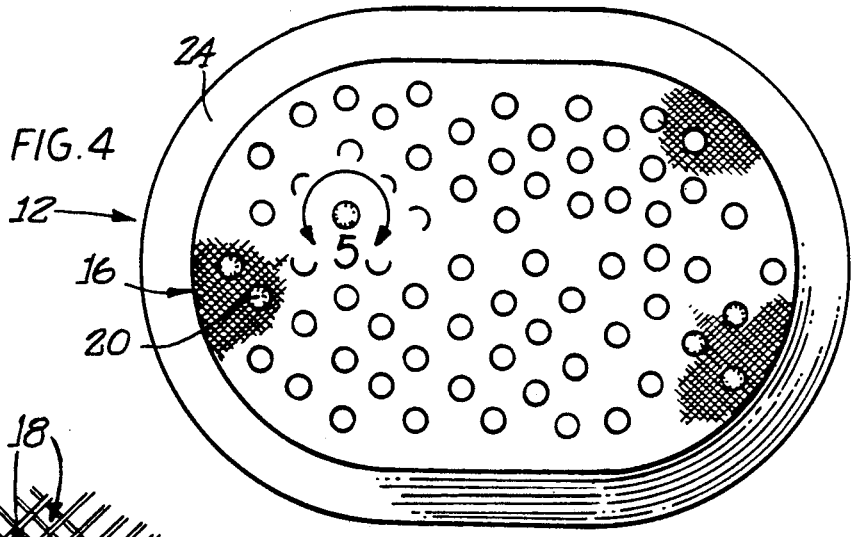
FIG. 4 is a top plan view of the hairpiece foundation shown in FIG. 3.
Figure 5:
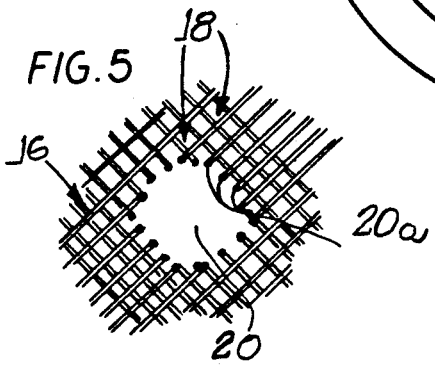
FIG. 5 is an enlarged view of a portion of the hairpiece foundation and aperture within the circular line indicated by numeral 5 as shown in FIG. 4.

Referring to FIG. 1, the balding area on the head of a wearer is covered by a hairpiece generally designated by reference character 10. The hairpiece 10 includes a reticulate foundation sheet member 12 (also shown in FIGS. 3 and 4) and a body of hair generally designated by reference character 14 (shown in phantom). The body of the foundation 12 preferably has a mesh structure 16 as best shown in FIGS. 4 and 5 which provides for comfortable ventilation of the wearer's head. The fibers of the hair 14 are secured to the foundation mesh 16, preferably by pulling or knotting (not shown) through individual mesh holes 18 in the preferred manner more fully described in the aforementioned U.S. Pat. No. 4,517,999.

Figure 3:
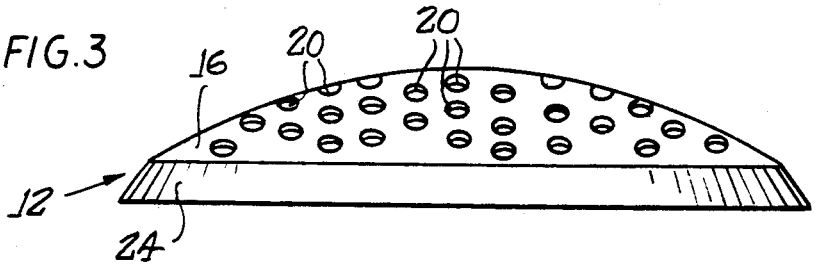
FIG. 3 is a side view of the hairpiece foundation shown in FIGS. 1 and 2.
Figure 6:
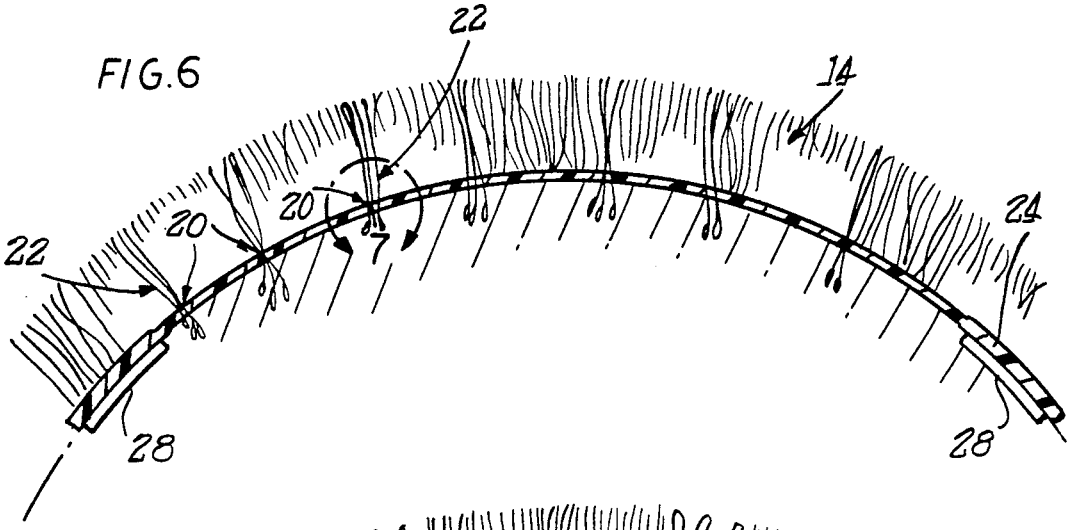
FIG. 6 is a sectional view of the fitted hairpiece along line 6—6 in FIG. 1.
Figure 7:
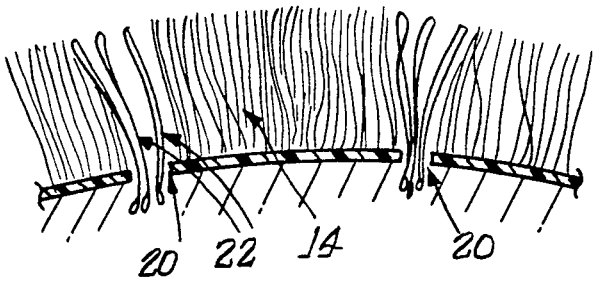
FIG. 7 is an enlarged view of the fitted hairpiece portion within the circular line indicated by numeral 7 in FIG. 6.

The foundation mesh structure 16 can be suitably fabricated from monofilament nylon fiber and similar materials which can be shaped to achieve a generally domed configuration conforming to the contour of the wearer's head as shown in FIG. 3. The mesh structure 16 is also perforated to produce a distributed arrangement of spaced apertures 20 which may have diameters generally in the range of approximately twice the mesh size up to one-half inch depending on the local density of the wearer's hair, in order to allow improved fitting of the hairpiece on the wearer's head by manipulating the wearer's own hair strands 22 through the apertures 20 as shown in FIGS. 6 and 7. After punching or otherwise perforating the preferred nylon mesh structure 16 to fabricate the apertures 20, the aperture periphery 20*a* is preferably heated to melt and soften the severed ends of the mesh filaments in order to eliminate any sharp projections so that the mesh structure is comfortably engaged with the scalp of the wearer.

Referring again to FIG. 3, a circumscribing border 24 of flexible material such as polyurethane film or similar material is bonded to the periphery of the foundation mesh structure 16. Such bonding can be achieved by fusing, for example by application of a mixture of dimethylforamide and toluene in a ratio of approximately 3:2 parts by weight respectively.

Figure 2:
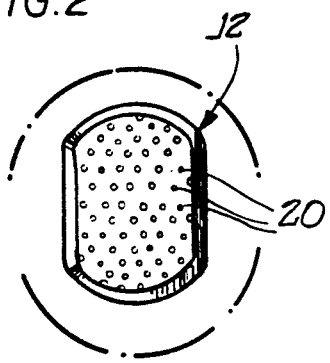
FIG. 2 is a top plan view of a hairpiece foundation shown in FIG. 1 and illustrating the blocking of the foundation upon a form.

Referring to FIG. 2, the nylon mesh structure 16 of the reticulate foundation 12 can be shaped to the general contour of the wearer's head by initially soaking the foundation 12 in boiling water to sufficiently soften and thereafter vacuum forming or heat curing and blocking the foundation 12 on a hard shell or form 26.

In fitting the hairpiece 10, and following the guiding of the wearer's own hair strands 22 through the apertures 20, the hairpiece foundation 12 can be secured to the wearer's scalp 26 in any conventional manner, and preferably by applying suitable double-sided tape between the scalp and the undersurface of the bonded foundation border 24. As a result, the projection of the wearer's own hair strands 22 through the apertures 20 not only augments the stability and securement of the hairpiece foundation by the distributed anchoring of the wearer's own hair, but in addition the distributed anchoring also provides particularly enhanced, natural-looking appearance of the applied hairpiece 10.

While particular embodiments of the hairpiece and fitting method have been described herein, it will be obvious to those skilled in the art that changes and modifications in various aspects may be made without departing from the broad scope of the invention. For example, in some modified embodiments of the hairpiece, a vacuum-formed and heat-treated flexible sheet member of polyurethane film with apertures punched therein can be substituted for the mesh structure of the foundation, with suitable modifications in the securement of the hairpiece hair strands to the foundation film. Consequently, the scope of the invention is not limited by any particular embodiment but is defined by the appended claims and the equivalence thereof.

The invention is claimed as follows:

1. A hairpiece comprising:

a reticulate foundation sheet member having filaments forming a mesh structure of generally regular mesh openings between said filaments, and having a plurality of apertures defined by interruptions in some of said filaments to form filament ends at the periphery of said apertures said filament ends having been melted non-sharp to eliminate sharp projections thereon, said apertures being formed in at least a centrally located expanse of said mesh structure with respective aperture dimensions larger than said mesh openings in order to enable feeding of the wearer's own hair strands through said respective apertures to produce improved appearance and securement of said hairpiece to the wearer's head; and applied hair strands secured directly to said reticulate foundation of said hairpiece.

2. A hairpiece according to claim 1, wherein said apertures are distributed in a generally uniformly spaced arrangement.

3. A hairpiece according to claim 2, wherein said apertures have respective dimensions in the range of approximately $\frac{1}{8}$–$\frac{1}{4}$ inch diameter.

4. A hairpiece according to claim 1, wherein said reticulate sheet member further includes a border of flexible film material generally circumscribing said mesh structure.

5. A hairpiece according to claim 1, wherein the mesh structure of said reticulate foundation sheet member has a composition comprising nylon fiber.

* * * * *